US005387142A

United States Patent [19]

Takayanagi et al.

[11] Patent Number: 5,387,142

[45] Date of Patent: Feb. 7, 1995

[54] POWER STEERING DEVICE FOR OUTBOARD ENGINE

[75] Inventors: Hisao Takayanagi; Yasuo Funami, both of Saitama, Japan

[73] Assignee: Kabushiki Kaisha Showa Seisakusho, Saitama, Japan

[21] Appl. No.: 974,115

[22] Filed: Nov. 10, 1992

[30] Foreign Application Priority Data

Nov. 11, 1991 [JP] Japan ..... 3-322516

[51] Int. Cl.[6] ..... B63H 5/12

[52] U.S. Cl. ..... 440/61; 440/900; 114/144 R

[58] Field of Search ..... 440/53, 61, 62, 63, 440/900; 114/144 R; 417/44 R; 74/480 R, 480 B; 180/132, 145, 150, 102

[56] References Cited

U.S. PATENT DOCUMENTS 4,595,370 6/1986 Small ..... 440/62
4,710,141 12/1987 Ferguson ..... 440/61
4,976,639 12/1990 Rawlings et al. ..... 440/59

*Primary Examiner*—Edwin L. Swinehart
*Attorney, Agent, or Firm*—Howard L. Rose

[57] ABSTRACT

A power steering device for steering an outboard engine on a small boat has a hydraulic cylinder unit for angularly moving a steering arm of the outboard engine, the hydraulic cylinder unit having a piston rod connected to the steering arm, and a directional control spool valve for supplying a hydraulic pressure to the hydraulic cylinder unit to move the piston rod. A control cable controls the directional control spool valve in response to operation of a steering wheel. The control cable has a core having an end coupled to the piston rod and a sheath covering the core and having an end coupled to the spool of the directional control spool valve. The hydraulic cylinder unit has a cylinder divided by a piston into a first oil chamber through which the piston rod extends and a second oil chamber remote from the piston rod. The directional control spool valve has an oil passage which interconnects the first and second oil chambers when the directional control valve supplies the hydraulic pressure to the second oil chamber.

1 Claim, 5 Drawing Sheets

POWER STEERING DEVICE FOR OUTBOARD ENGINE

BACKGROUND OF THE INVENTION

1. Field of the Invention

The present invention relates to a power steering device having a hydraulic cylinder unit that is actuatable in response to turning of a steering wheel for steering an outboard engine mounted on the back of a small boat.

2. Description of the Prior Art

One known power steering device for an outboard engine is disclosed in Japanese laid-open patent publication No. 2-147497 which corresponds to U.S. Pat. No. 4,976,639. The disclosed power steering device has a control cable extending from a steering member, the control cable comprising a core and a sheath. The core is fixed to a bracket on the distal end of a piston rod of a hydraulic cylinder unit that is actuatable to swing the outboard engine in a horizontal direction. The sheath is coupled to a steering tube which is movable with the sheath when the steering member is turned. The movement of the steering tube is transmitted through a gear or a lever to a spool valve, which supplies working oil from a pump into an oil chamber in the hydraulic cylinder unit. The supplied working oil moves the piston rod for swinging a steering arm to steer the outboard engine.

Since the movement of the sheath is transmitted through the steering tube and the gear or lever to the spool valve, the number of parts required is relatively large. An oil seal is required between sliding surfaces of the steering tube and a housing which accommodates the steering tube.

SUMMARY OF THE INVENTION

It is an object of the present invention to provide a power steering device for an outboard engine, which is made up of a relatively small number of parts, is of a relatively simple structure, and is free from oil leakage.

According to the present invention, there is provided a power steering device for steering an outboard engine, comprising a hydraulic cylinder unit for angularly moving a steering arm of the outboard engine, the hydraulic cylinder unit having a piston rod adapted to be connected to the steering arm, a directional control valve for supplying a hydraulic pressure to the hydraulic cylinder unit to move the piston rod, the directional control valve having an axially movable member, and a control cable for controlling the directional control valve in response to operation of a steering wheel, the control cable comprising a core having an end coupled to the piston rod and a sheath covering the core and having an end coupled to the axially movable member.

The power steering device may also comprise a joint connecting the end of the sheath to the axially movable member, the Joint extending transversely to the sheath, a nut connecting the joint to the end of the sheath, an arm coupled to the piston rod, the arm having an end adapted to be connected to the steering arm and an opposite end connected to the end of the core, a tubular body pivotally coupled to the opposite end of the arm, the core extending through the tubular body with the end of the core being fixed to a bottom of the tubular body, and a second sheath coaxially joined to the sheath of the control cable and covering the core, the second sheath being inserted in the tubular body.

The directional control valve may comprise a spool valve having a spool as the axially movable member.

According to the present invention, there is also provided a power steering device for steering an outboard engine, comprising a hydraulic cylinder unit for angularly moving a steering arm of the outboard engine, the hydraulic cylinder unit having a cylinder, a piston slidably disposed in the cylinder, and a piston rod joined to the piston and adapted to be connected to the steering arm, the piston dividing the cylinder into a first oil chamber through which the piston rod extends and a second oil chamber remote from the piston rod, and a directional control valve actuatable in response to operation of a steering wheel for supplying a hydraulic pressure to the hydraulic cylinder unit to move the piston rod, the directional control valve having an oil passage which interconnects the first and second oil chambers when the directional control valve supplies the hydraulic pressure to the second oil chamber.

The piston has a first cross-sectional area and the piston rod has a second cross-sectional area, the difference between the first and second cross-sectional areas being substantially the same as the second cross-sectional area.

The directional control valve may comprise a spool valve having an axially movable spool, and the power steering device may further comprise a neutral position sensor for detecting when the axially movable spool is in a neutral position, and a pump responsive to a signal from the neutral position sensor for supplying the hydraulic pressure to the directional control valve.

The directional control valve may comprise a spool valve having an axially movable spool, and the power steering device may further comprise a control cable for controlling the directional control valve in response to operation of the steering wheel, the control cable comprising a core having an end coupled to the piston rod and a sheath covering the core and having an end coupled to the axially movable spool.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
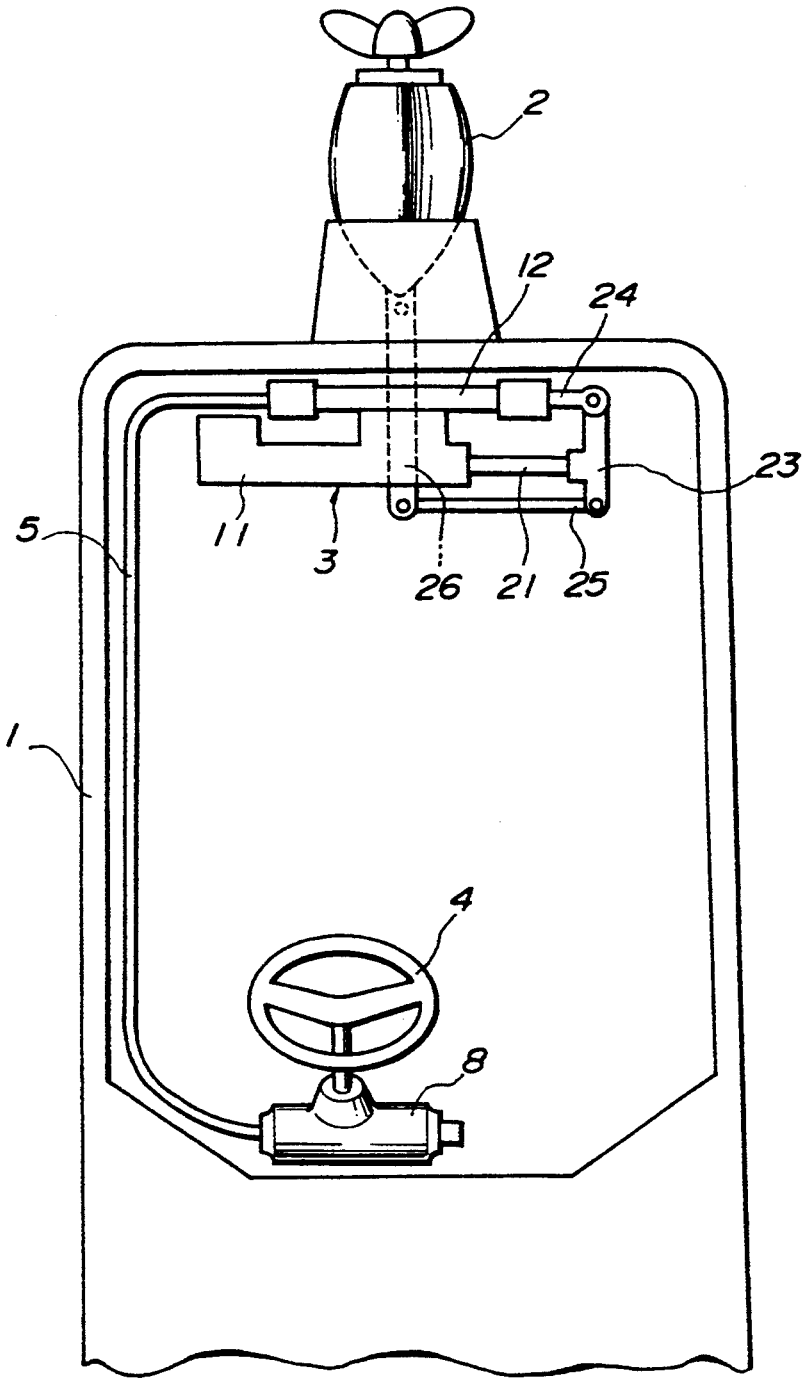
FIG. 1 is a fragmentary plan view of a boat which incorporates a power steering device for an outboard engine according to the present invention.

As shown in FIG. 1, a boat 1 has an outboard engine 2 mounted on the stern for horizontal angular movement about a vertical axis. The outboard engine 2 can be steered by a power steering device 3 positioned in the back of the boat 1 near the outboard engine 2. The power steering device 3 is operatively connected to a steering wheel 4 through a control cable 5 which extends along one side of the cabin.

Figure 2:
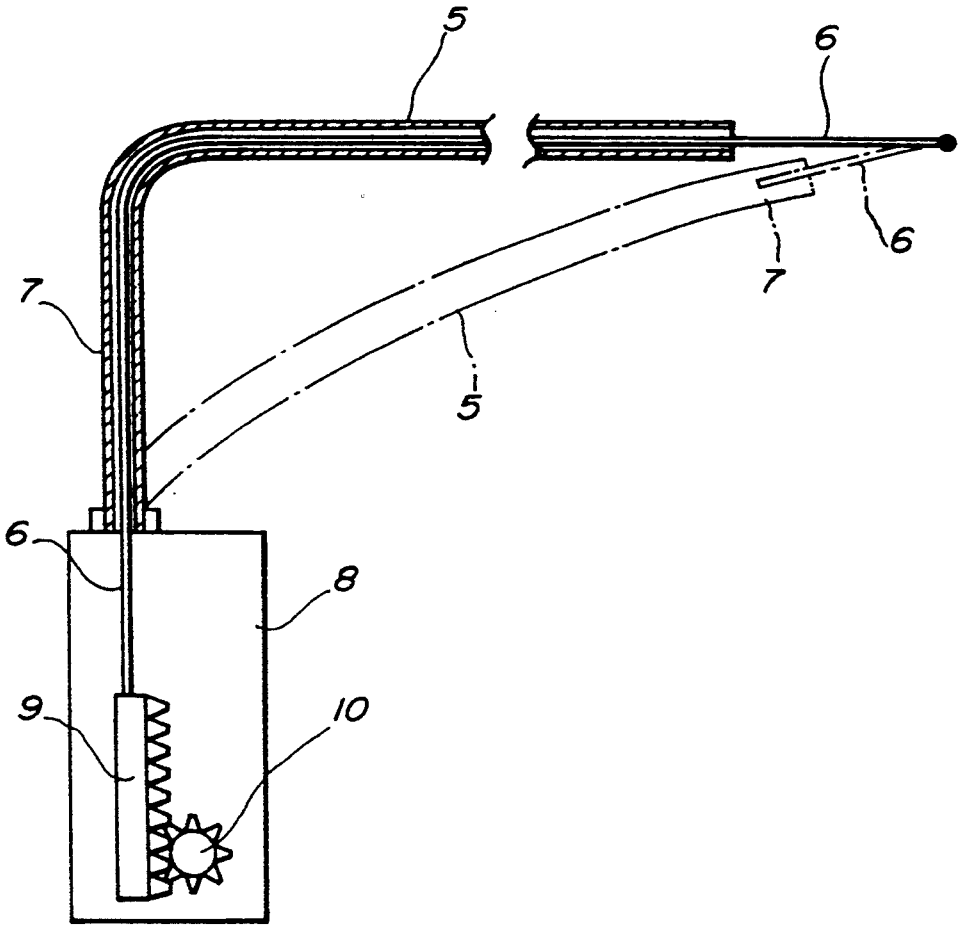
FIG. 2 is a fragmentary cross-sectional view of a control cable.

As shown in FIG. 2, the control cable 5 comprises a core 6 and a sheath 7 through which the core 6 extends. The sheath 7 has a rear end (lower end in FIG. 2) fixed to a casing 8 on which the steering wheel 4 is rotatably supported. The core 6 has a rear end extending into the casing 8 and fixed to one end of a rack 9 movably disposed in the casing 8. The rack 9 is held in mesh with a gear 10 that is rotatable about its own axis when the steering wheel 4 is turned.

Figure 3:
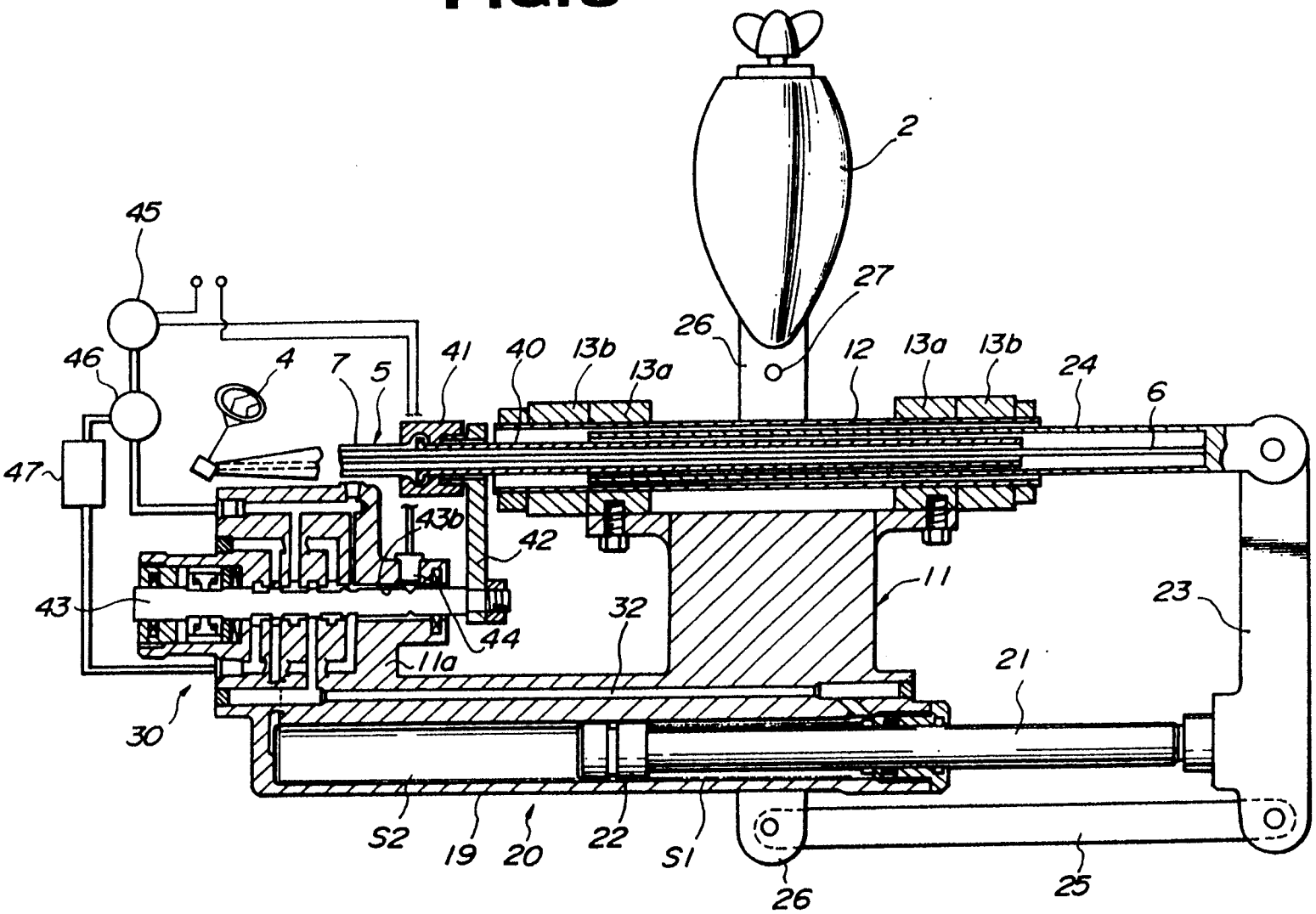
FIG. 3 is a cross-sectional view of the power steering device.

As shown in FIG. 3, the power steering device 3 has a block 11 fixed to swivel brackets 13*a* which are vertically swingably supported on a tilt tube 12 that is fixed to stern brackets 13*b* mounted on the stern of the boat 1. The outboard engine 2, which is attached to the swivel brackets 13*a*, can be tilted upwardly or downwardly by a tilt cylinder (not shown).

The power steering device 3 also has a hydraulic cylinder unit 20 and a directional control spool valve 30 that are assembled in the block 11.

The hydraulic cylinder unit 20 has a piston rod 21 supporting a piston 22 on one end thereof, the piston rod 21 extending substantially parallel to the tilt tube 12. The piston 22 is slidably disposed in a cylinder 19 that is divided by the piston 22 into an oil chamber S1 through which the piston rod 21 axially extends and an oil chamber S2 remote from the piston rod 21. The circular cross-sectional area of the piston 22 is larger than the circular cross-sectional area of the piston rod 21 by an amount which is substantially the same as the circular cross-sectional area of the piston rod 21. Stated otherwise, the circular cross-sectional area of the piston rod 21 is about half the circular cross-sectional area of the piston 22.

The piston rod 21 has an end projecting out of the cylinder 19, and an arm 23 is fixed to the projecting end of the piston rod 21. An elongate tubular body 24 extending through the tilt tube 12 has one end fixed to one end of the arm 23. To the other end of the arm 23, there is pivotally coupled one end of a lever 25 extending parallel to the piston rod 21, the other end of the lever 25 being pivotally connected to one end of a steering arm 26 which is coupled to the outboard engine 2 for steering the same. The steering arm 26 is pivotally coupled to the boat 1 by a vertical shaft 27.

The core 6 has an end portion remote from the casing 8, the end portion extending out of the sheath 7 and into another sheath 40 which is inserted in the tilt tube 12 and extends in the tubular body 24. The end portion of the core 6 projects out of the sheath 40 and is fixed at its end to the right end wall of the tubular body 24 near the arm 23. The sheath 40 has one end securely fastened coaxially to the sheath 7 by a nut 41 to which there is connected one end of a connecting arm 42 extending transversely across the sheath 40. The other end of the connecting arm 42 is connected to one end of a spool 43 axially movably fitted in a bore 43*b* defined in a block portion 11*a* in which the directional control spool valve 30 is disposed.

A motor 45 is coupled to a pump 46 for actuating the pump 46 to supply working oil from a tank 47 to the spool valve 30.

Figure 4:
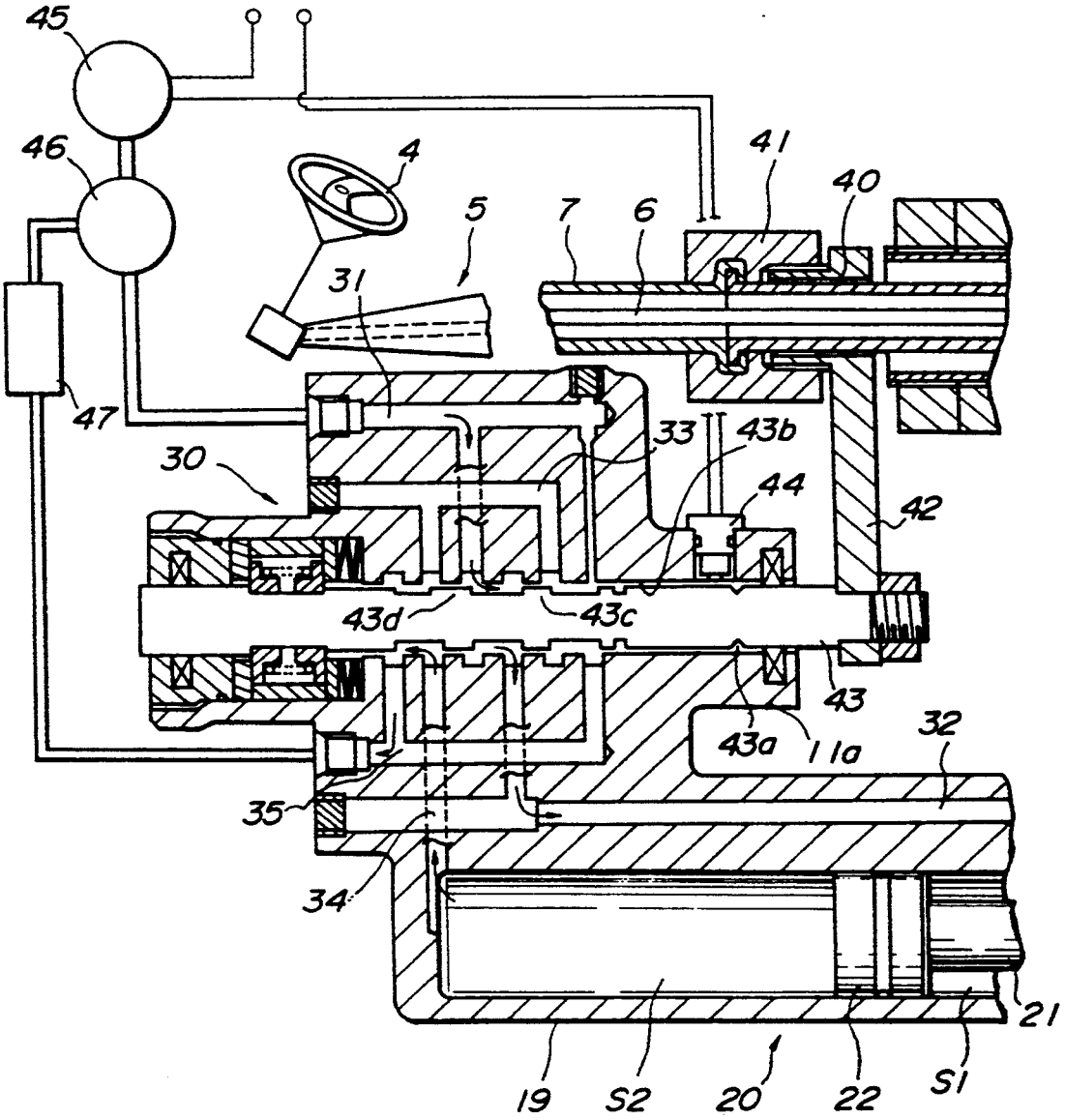
FIG. 4 is an enlarged fragmentary cross-sectional view of the power steering device, showing oil flows in a directional control spool valve when a hydraulic cylinder unit is in a contraction stroke.

The spool 43 has a pair of axially spaced annular lands 43*c*, 43*d*, see FIG. 4. The block portion 11*a* has defined therein an oil passage 31 which is connected to the pump 46 and has an end opening into the bore 43*b* between the lands 43*c*, 43*d*, an oil passage 33 having opposite ends opening into the bore 43*b*, an oil passage 34 communicating with the oil chamber S2 and has an end opening into the bore 43*b*, and an oil passage 35 communicating with the tank 47 and having opposite ends opening into the bore 43*b*. The hydraulic cylinder unit 20 has an oil passage 32 defined parallel to the cylinder 19 and having one end communicating with the oil chamber S1 and the other end opening into the bore 43*b*.

A neutral position sensor 44 such as a limit switch is mounted in the block portion 11*a* and exposed in the bore 43*b* for detecting whether the spool 43 is in a neutral position or not in coaction with an annular groove 43*a* defined in the outer circumferential surface of the spool 43. When the spool 43 is in the neutral position as detected by the limit switch 44 that is aligned with the annular groove 43*a*, the motor 45 is de-energized and no working oil is supplied to the spool valve 30. When the spool 43 is not in the neutral position, the motor 45 is energized to enable the pump 46 to supply working oil from the tank 47 to the spool valve 30, from which the working oil is supplied to the hydraulic cylinder unit 20. Since the motor 45 is de-energized and hence the pump 46 is not actuated when the spool 43 is in the neutral position, any power loss caused by the power steering device is minimized.

Figure 5:
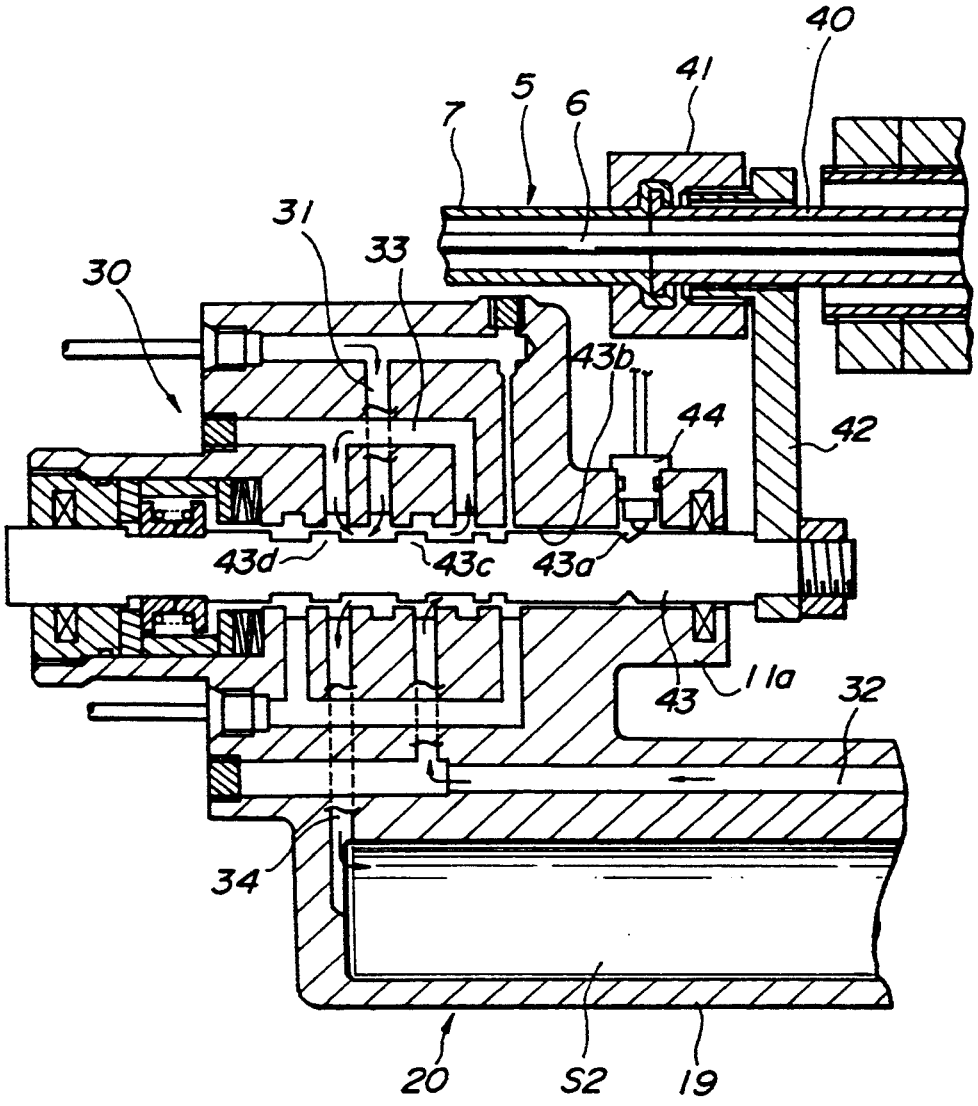
FIG. 5 is an enlarged fragmentary cross-sectional view of the power steering device, showing oil flows in the directional control spool valve when the hydraulic cylinder unit is in an expansion stroke.

Operation of the power steering device will be described below with reference to FIGS. 4 and 5.

First, a contraction stroke of the hydraulic cylinder unit 20 to retract the piston rod 21 will be described with reference to FIG. 4. As shown in FIG. 2, the steering wheel 4 is turned in a direction to draw the core 6 into the casing 8 through the gear 10 and the rack 9. Since the distal end of the core 6 is affixed to the right end wall of the tubular body 24 and the tubular body 24 is coupled to the arm 23 joined to the piston rod 21, the affixed end of the core 6 and the tubular body 24 are not readily moved when the steering wheel 4 is turned. As a result, inasmuch as the core 6 is pulled into the casing 8, the control cable 5 is flexed to a smaller extent as indicated by the imaginary lines in FIG. 2, with the result that the distal end of the sheath 7 moves toward the affixed end of the core 6, i.e., to the right in FIG. 4.

The connecting arm 42 joined to the sheath 7 by the nut 41, and the spool 43 coupled to the joint 42 are moved in unison with each other to the right. The annular groove 43*a* is displaced out of alignment with the limit switch 44, whereupon the motor 45 is energized to cause the pump 46 to supply working oil from the tank 47 to the spool valve 30. The supplied working oil flows through the oil passage 31 across the spool 43 between the lands 43*c*, 43*d* and also through the oil passage 32 into the oil chamber S1 of the hydraulic cylinder unit 20. Working oil in the oil chamber S2 returns through the oil passages 34, 35 to the tank 47. Because of a pressure buildup in the oil chamber S1, the piston 22 is displaced to the left, retracting the piston rod 21 into the cylinder 19. Upon retraction of the piston 21, the arm 23 and the lever 25 (see FIG. 3) are also moved to the left, turning the steering arm 26 clockwise about the shaft 27 to steer the outboard engine 2 in one direction, i.e., to the right in FIG. 3.

An expansion stroke of the hydraulic cylinder unit 20 to project the piston rod 21 will be described with reference to FIG. 5. The steering wheel 4 is turned in the opposite direction to flex the control cable 5 to a greater extend, moving the distal end of the sheath 7 away from the affixed end of the core 6, i.e., to the left in FIG. 5. The spool 43 also moves to the left in unison with the sheath 7. The pump 46 actuated by the motor 45 supplies working oil from the tank 47 through the oil passage 31 across the spool 43 between the lands 43*c*, 43*d*, and through the oil passage 34 into the oil chamber S2. Working oil in the oil chamber S1 flows through the oil passages 32, 35 back to the tank 47. The piston rod 21 is caused by a pressure buildup in the oil chamber S2 to project in a direction out of the cylinder 19. The outboard engine 2 is now steered in the opposite direction, i.e., to the left in FIG. 3.

Since the sheath 7 is coupled to the spool 43 through the connecting arm 42, no steering tube is necessary. Therefore, the power steering device is made up of a relatively small number of parts, is of a relatively simple structure, and is free from oil leakage which would otherwise occur between a steering tube and a housing which accommodates the steering tube.

The difference between the cross-sectional areas of the piston 22 and the piston rod 21 is substantially the same as the cross-sectional area of the piston rod 21, i.e., the cross-sectional area of the piston 22 is about twice the cross-sectional area of the piston rod 21. Since the area of the piston 22 which bears the pressure buildup when the piston rod 21 projects is about twice the area of the piston 22 which bears the pressure buildup when the piston rod 21 is retracted, the piston rod 21 projects at a speed that is half the speed at which the piston rod 21 is retracted. However, in the expansion stroke, the oil chambers S1, S2 communicate with each other through the oil passages 32, 33, 34, and hence the amount of working oil flowing into the oil chamber S2 is the sum of the amount of working oil supplied from the oil passage 31 and the amount of working oil flowing from the oil chamber S1, which corresponds to a reduction in the volume of the oil chamber S1. Since the total amount of working oil flowing into the oil chamber S2 in the expansion stroke is about twice the amount of working oil flowing into the oil chamber S1 in the contraction stroke, the outboard engine 2 is steered at the same speed irrespective of whether the steering wheel 4 is turned in one direction or the other.

What is claimed is:

1. A power steering device for steering an outboard engine, comprising:

a hydraulic cylinder unit for angularly moving a steering arm of the outboard engine, said hydraulic cylinder unit having a cylinder, a piston slidably disposed in said cylinder, and a piston rod joined to said piston and adapted to be connected to the steering arm, said piston dividing said cylinder into a first oil chamber through which said piston rod extends and a second oil chamber remote from said piston rod;

a directional control valve actuatable in response to operation of a steering wheel for supplying a hydraulic pressure to said hydraulic cylinder unit to move said piston rod, said directional control valve having an oil passage which interconnects said first and second oil chambers when the directional control valve supplies the hydraulic pressure to said second oil chamber; and wherein said directional control valve comprising a spool valve having an axially movable spool and further comprising a neutral position sensor for detecting when said axially movable spool is in a neutral position, and producing a signal when the axially movable spool is out of the neutral position, and a pump responsive to the signal from said neutral position sensor for supplying the hydraulic pressure to said directional control valve.

* * * * *